US010071295B1

(12) United States Patent
Palmer et al.

(10) Patent No.: US 10,071,295 B1
(45) Date of Patent: Sep. 11, 2018

(54) OUTDOOR GAME

(71) Applicants: Josh J. Palmer, Willsboro, NY (US); Kenny Alterie, Peru, NY (US)

(72) Inventors: Josh J. Palmer, Willsboro, NY (US); Kenny Alterie, Peru, NY (US)

( * ) Notice: Subject to any disclaimer, the term of this patent is extended or adjusted under 35 U.S.C. 154(b) by 0 days.

(21) Appl. No.: 15/827,678

(22) Filed: Nov. 30, 2017

(51) Int. Cl.
*A63B 67/06* (2006.01)
*A63B 63/08* (2006.01)
*A63B 63/00* (2006.01)

(52) U.S. Cl.
CPC ..... *A63B 67/06* (2013.01); *A63B 63/08* (2013.01); *A63B 63/00* (2013.01); *A63B 2210/50* (2013.01)

(58) Field of Classification Search
CPC ..... A63B 63/00; A63B 67/06
USPC ..... 273/398–402
See application file for complete search history.

(56) References Cited

U.S. PATENT DOCUMENTS 1,072,954 A * 9/1913 Junn ..... A63F 7/02 273/394
3,100,642 A * 8/1963 Goldstein ..... A63F 3/00895 206/459.5
3,990,703 A * 11/1976 Evans ..... A63B 67/06 273/400
4,826,177 A * 5/1989 Ponte ..... A63B 43/002 273/400
4,982,966 A * 1/1991 Teafatiller ..... A63B 67/06 273/336
7,500,674 B2 * 3/2009 Riley ..... A63B 67/06 273/126 R
D646,334 S * 10/2011 Ingram ..... D21/303
8,157,265 B2 4/2012 Conville et al.
D693,883 S * 11/2013 Wilson, Jr. ..... D21/303
8,794,629 B1 * 8/2014 Humphreys, Jr. ..... A63B 67/06 273/400
8,807,569 B1 8/2014 Davis
9,381,414 B1 7/2016 Gatton et al.
9,687,709 B2 * 6/2017 Riniti ..... A63B 67/06
2002/0130467 A1 * 9/2002 Woods ..... A63B 63/00 273/398
2008/0237990 A1 * 10/2008 Litz ..... A63B 67/06 273/400
2009/0115136 A1 * 5/2009 Voden ..... A63B 21/0053 273/336
2010/0164175 A1 7/2010 Buchanan
2013/0082442 A1 * 4/2013 Hanel ..... A63B 63/00 273/398

(Continued)

OTHER PUBLICATIONS

BeanBagglz: World's First Beanbag Tossing Game with . . . Product description [online]. Kickstarter, PBC © 2018 [retrieved on Aug. 11, 2017]. Retrieved from the Internet: URL: https://www.kickstarter.com/projects/beanbagbilliards/hot-new-summer-game-cornhole-on-steroids>.

*Primary Examiner* — Mark Graham
(74) *Attorney, Agent, or Firm* — Cramer Patent & Design, PLLC; Aaron R. Cramer

(57) ABSTRACT

An outdoor game comprises a pair of game assemblies each having a pair of hinged legs, a plurality of scoring devices and a plurality of cuboid cubby holes disposed upon a first face. There is at least one (1) open cubby hole. Each cubby hole has a point value denoted above a back wall of each cubby hole. The open cubby hole is assigned a point value. A score is generated when at least one (1) scoring device is pitched into or through one (1) cubby hole. Along the front edge on both the top and bottom is a hasp enabling the assemblies to be joined to another board.

12 Claims, 4 Drawing Sheets

(56) References Cited

U.S. PATENT DOCUMENTS

| | | | | |
|---|---|---|---|---|
| 2014/0091525 | A1* | 4/2014 | Ramirez | A63B 63/08<br>273/402 |
| 2015/0069708 | A1* | 3/2015 | Mashburn | A63B 67/06<br>273/400 |
| 2015/0108719 | A1 | 4/2015 | Devine | |
| 2015/0115532 | A1* | 4/2015 | Martinson | A63B 67/06<br>273/400 |

* cited by examiner

OUTDOOR GAME

RELATED APPLICATIONS

The are no related applications.

FIELD OF THE INVENTION

The present invention relates generally to an outdoor game.

BACKGROUND OF THE INVENTION

When the weather is nice, outdoor games such as horseshoes, cornhole, ring toss, lawn darts, croquet, washer toss, and the like may be observed being played in parks and backyards across the globe. In fact, such games are especially attractive when they are part of a larger activity such as a party or picnic.

While there are many options, a small list of which being list above, a small number seem to stand out from the rest namely, horseshoes, corn hole and washer toss. There are probably many reasons these games are so popular but it would seem a few such factors would be easy rules, accessibility of play for anyone of virtually any age, and affordability, but perhaps the simplest reason is these games are just fun.

While horseshoes, corn hole and washer toss are perhaps equally fun and easy to play for all, few outdoor occasions provide access to all three (3) games. This may be due to constraints of space, resources or both. Therefore, the need exists for an outdoor game that provides the challenges and benefits of these three (3) games into a single game. The development of the outdoor game fulfills this need.

SUMMARY OF THE INVENTION

The inventor has recognized the aforementioned inherent problems and lack in the art and observed that there is a need for an outdoor game as described above.

It is therefore an object of the invention to provide a game comprising a first game assembly, a second game assembly, at least one (1) scoring device and a locking mechanism. The first game assembly comprises a first game first side, a first game second side, a first game third side opposite the first game first side, a first game fourth side opposite the first game second side, a first game first divider, horizontally disposed between the first game fourth side and the first game second side, a first game second divider, vertically disposed between the first game first divider and the first game first side, a first game third divider, adjacent the first game second divider and vertically disposed between the first game first divider and the first game first side, a first game fourth divider, vertically disposed between the first game first divider and the first game third side, a first game board secured beneath the first game first, the first game second side, the first game third side and the first game fourth side and a first pair of legs moveably secured to opposite external sides of the second game first side. The first game first divider, the first game second divider, the first game third divider and the first game fourth divider are positioned to create a first plurality of scoring regions.

The second game assembly comprises a second game first side, a second game second side, a second game third side opposite the second game first side, a second game fourth side opposite the second game second side, a second game first divider, horizontally disposed between the second game fourth side and the second game second side, a second game second divider, vertically disposed between the second game first divider and the second game first side, a second game third divider, adjacent the second game second divider and vertically disposed between the second game first divider and the second game first side, a second game fourth divider, vertically disposed between the second game first divider and the second game third side, a second game board secured beneath the second game first, the second game second side, the second game third side and the second game fourth side and a second pair of legs moveably secured to opposite external sides of the second game first side. The second game first divider, the second game second divider, the second game third divider and the second game fourth divider are positioned to create a second plurality of scoring regions. The first game and the second game are capable of being removably secured together by the locking mechanism. The first plurality of scoring regions and the second plurality of scoring regions are each individually capable of retaining the at least one the scoring device therein.

In a separate embodiment, in addition to the foregoing, a first pair of leg stops are secured at opposite ends of the first game first side adjacent the first pair of legs while a second pair of leg stops are secured at opposite ends of the second game first side adjacent the second pair of legs.

The first plurality of scoring regions and/or the second plurality of scoring regions may number five (5). The first game board and the second game board may not cover one (1) of the first plurality of scoring regions and/or second plurality of scoring regions.

The first game and second game may further comprise a first game handle and a second game handle. The locking mechanism may comprise a first hasp disposed between the first game first side and the second game second side and/or a second hasp disposed between the first game third side and the second game third side. The first plurality of scoring regions and the second plurality of scoring regions may comprise indicia having a numerical value.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
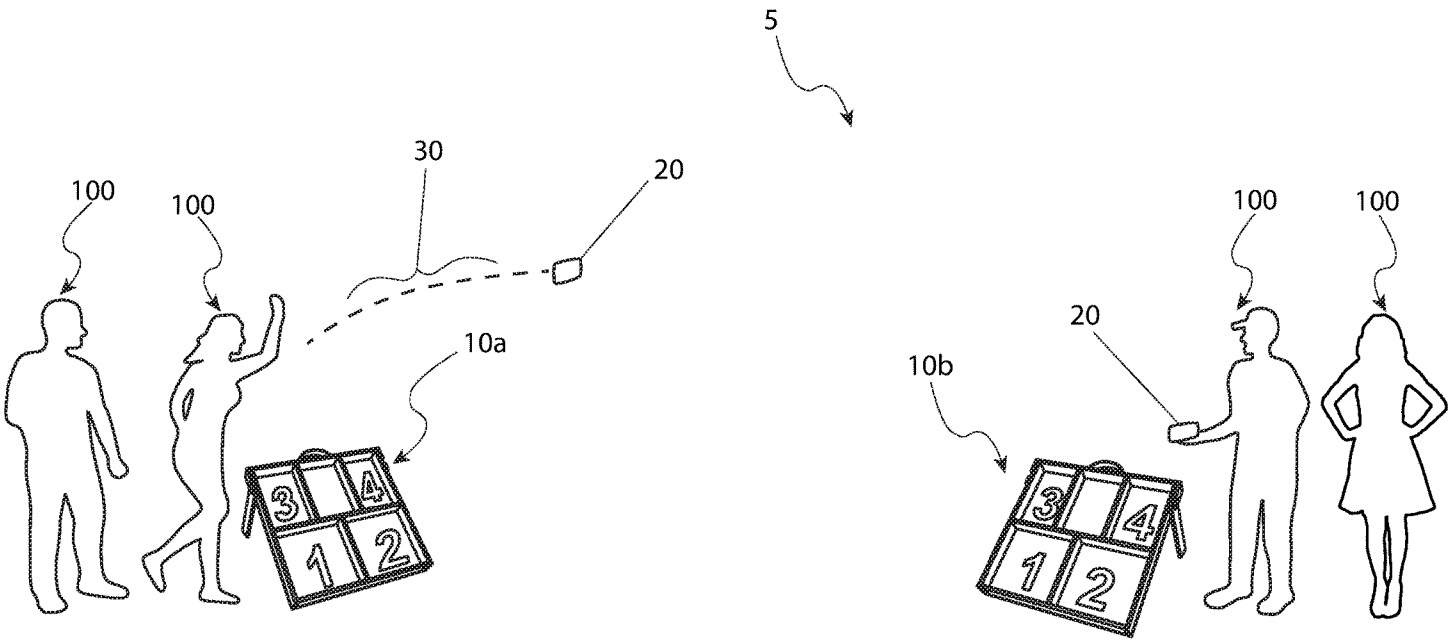
FIG. 1 is a perspective view of the outdoor game 5 being played by game players 100, in a preferred embodiment of the present invention.

5 outdoor game
10*a* first game assembly
10*b* second game assembly
20 scoring device
30 travel path

40 first scoring area
50 second scoring area
60 third scoring area
70 fourth scoring area
80 fifth scoring area
90*a* first leg
90*b* second leg
95*a* first leg stop
95*b* second leg stop
100 game player
110 handle
120 first side
130 second side
140 third side
150 fourth side
160 first divider
170 second divider
180 third divider
190 fourth divider
200 board
210 indicium
300*a,b* hasp first side
310*a,b* hasp locking ring
320*a,b* hasp second side

DETAILED DESCRIPTION OF THE PREFERRED EMBODIMENT

Referring to FIGS. 1-4, disclosing an outdoor game 5 (hereinafter the "game"). The disclosed game 5 comprises a first game assembly 10*a* and a second game assembly 10*b*. Both game assemblies 10*a*, 10*b* are identical in design (with one (1) exception, to be further discussed below) with each having a first scoring area 40, a second scoring area 50, a third scoring area 60, a fourth scoring area 70, and a fifth scoring area 80. The scoring areas 40, 50, 60, 70 and 80 of both game assemblies 10*a*, 10*b* are defined by a first side 120, a second side 130, a third side 140, a fourth side 150, a first divider 160, a second divider 170, a third divider 180, a fourth divider 190*a* and a board 200.

A plurality of game players 100 take turns attempting to toss a scoring device 20 along a travel path 30 into the scoring areas 40, 50, 60, 70 and 80 of either the first game assembly 10*a* or the second game assembly 10*b*. A score is generated depending upon the location of the scoring device 20 upon conclusion of the travel path 30 if the scoring device 20 lands within scoring areas 40, 50, 60 and 70 or travels through scoring area 80 which comprises an opening through the first game assembly 10*a* and 10*b*.

Referring now to FIG. 1, a perspective view of the game 5 being played by game players 100, in a preferred embodiment of the present invention is disclosed. The first game assembly 10*a* is set apart and in opposition to the second game assembly 10*b* by a distance of approximately forty (40 ft). In the preferred embodiment two (2) teams of two (2) game players 100 take turns pitching the scoring device 20 along the travel path 30 into the face of each game assembly 10*a*, 10*b* and recording the resulting score value indicating by indicium 210 disposed upon the front face of the board 200 of the game assemblies 10*a*, 10*b*. (See FIG. 2).

Figure 2:
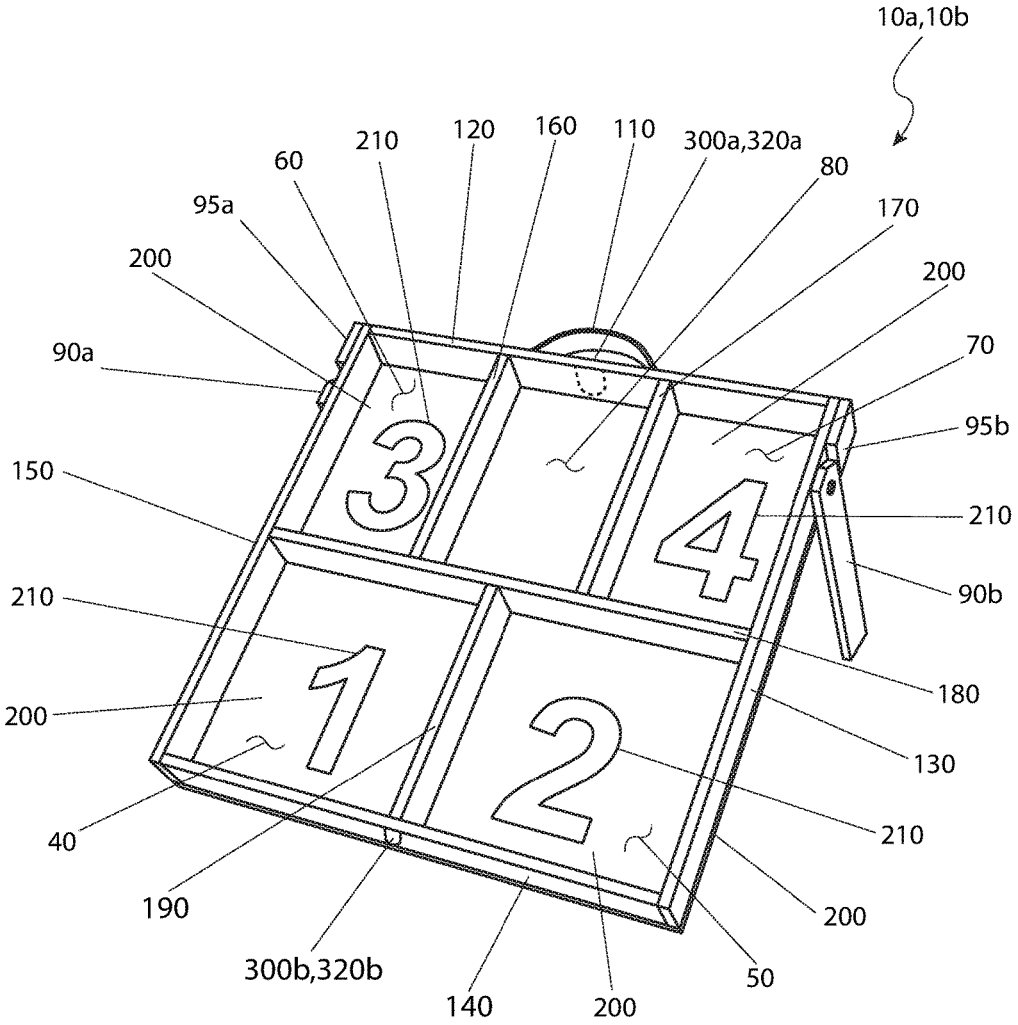
FIG. 2 is a perspective view of the first game assembly 10*a* and second game assembly 10*b* of the outdoor game 5 in a preferred embodiment of the present invention.

Referring now to FIG. 2, a perspective view of the first game assembly 10*a* and second game assembly 10*b* of the outdoor game 5 in a preferred embodiment of the present invention is disclosed. Each game assembly 10*a*, 10*b* comprises a generally square shaped planar device comprising the first side 120, the second side 130, the third side 140 opposite the first side 120 with the second side 130 disposed between the first side 120 and third side 140 and a fourth side 150 opposite the second side 130 disposed between the first side 120 and third side 140. The scoring areas 40, 50, 60, 70 and 80 have a generally square shape and are formed by a third divider 180 horizontally and centrally secured between the second side 130 and fourth side 150. The first divider 160 and second divider 170 are vertically and evenly secured between the third divider 180 and the first side 120. The fourth divider 190 is vertically and centrally disposed between the third divider 180 and third side 140. The board 200 is "U"-shaped and defines the rear of the first game assembly 10*a* and second game assembly 10*b*. The board 200 defines the back wall of the scoring areas 40, 50, 60 and 70 while the scoring area 80 remains open. Other shapes for the assemblies 10*a*, 10*b* and scoring areas 40, 50, 60, 70 and 80 may be considered.

A first leg 90*a* is moveably secured to an exterior of the fourth side 150 adjacent the first side 120. A second leg 90*b* is also moveably secured to an exterior of the second side 130 adjacent the first side 120. When deployed each leg 90*a* and 90*b* fall behind each game assembly 10*a*, 10*b* thereby displaying the face of each game assembly 10*a*, 10*b* at an angle of approximately thirty degrees (30°). This angle may be obtained by a first leg stop 95*a* and second leg stop 95*b* disposed respectively above the first leg 95*a* and the second leg 95*b*. A handle 110 is centrally disposed on an exterior side of the first side 120. On a front side face of each rear wall 200 of each scoring area 40, 50, 60 and 70 is an indicium 200 displaying a numerical value. In the preferred embodiment, scoring area 40 is ascribed the value of "1", scoring area 50 is ascribed the value of "2", scoring area 60 is ascribed the value of "3" and scoring area 70 is ascribed the value of "4". The open scoring area 80 is ascribed the value of "5" which is achieved when a scoring device 20 is pitched by the game player 100 through the scoring area 80. The respective scores of each scoring area 40, 50, 60 and 70 are awarded to a player 100 who pitches a scoring device 20 into the scoring area 40, 50, 60 or 70.

Figure 3:
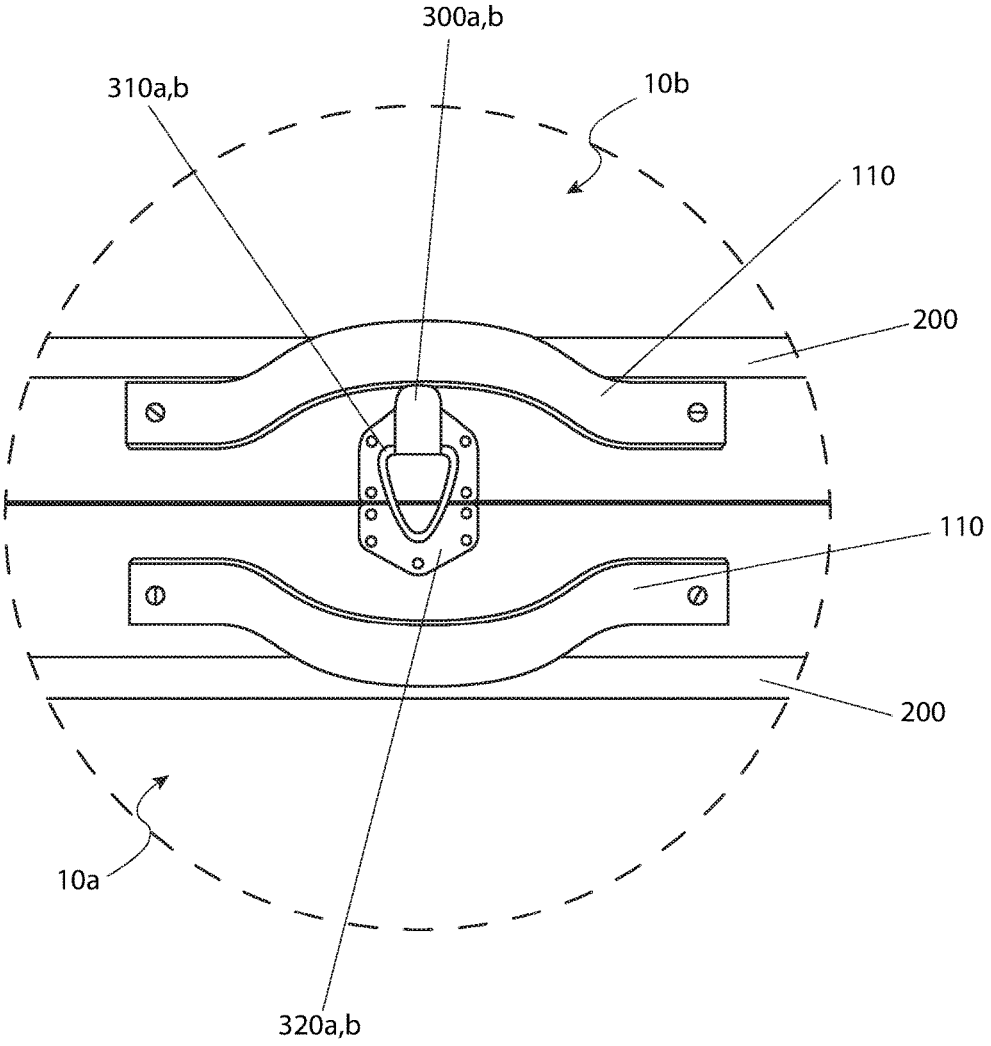
FIG. 3 is a top view of a locking mechanism of the first game assembly 10*a* and second game assembly 10*b* of the outdoor game 5; and, FIG. 4 is a perspective view of the first game assembly 10*a* and second game assembly 10*b* of the outdoor game 5, in a closed configuration, in a preferred embodiment of the present invention.
Figure 4:
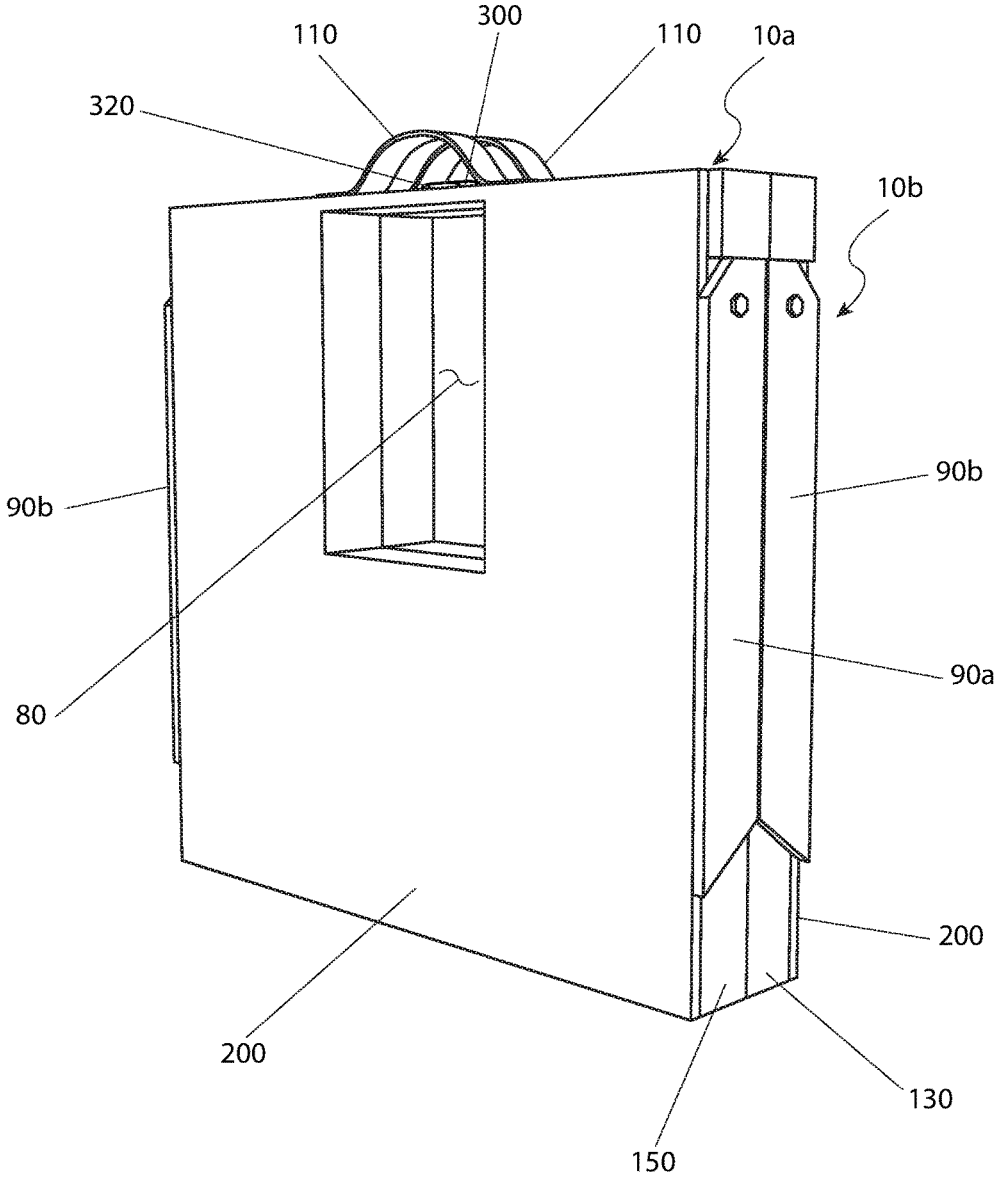

Referring last to FIGS. 3 and 4, a hasp first side 300*a* is secured subjacent the handle 110 on the first game assembly 10*a*. A hasp second side 300*b* is centrally secured on an exterior side of the third side 140. A mirror configuration is secured to the second game assembly 10*b* having a hasp second side 320*a* secured subjacent the handle 110 and a hasp first side 300*b* centrally secured on the exterior side of the third side 140. (See also FIG. 2). Each pair of mating hasps 300*a*, 320*a* and 300*b*, 320*b* comprise a respective locking ring 310*a,b*. Which enables each game assembly 10*a*, 10*b* to be secured to each other, face side in, in a manner depicted in FIG. 4.

The game 5 may be played in the preferred method as follows: First, at least two (2) teams, having two (2) game players 100 obtain the game 5; second, the game 5 is opened by releasing the hasp locks hasps 300*a*, 320*a* and 300*b*, 320*b* and removing the scoring devices 20 stored therein (in the preferred configuration, four (4) scoring devices 20 are provided and comprise a bean bag structure each weighing approximately one pound (1 lb.). Other scoring devices 20 being made of different materials such as rubber and filled with different materials such as sand are also contemplated); third, the game assemblies 10*a*, 10*b* are separated by a span of at least forty feet (40 ft.), with each scoring side facing each other having each game assembly 10*a*, 10*b* legs 90*a,b* deployed; fourth, each game player 100 from each team takes a turn pitching the scoring device 20 at the game assembly 10*a*, 10*b* opposite the game player 100; fifth, points are awarded based on the value of the indicium 210 assigned to the scoring area 40, 50, 60 and 70 when a scoring device hits and stays within a given scoring area 40, 50, 60 and 70 or when a scoring device 20 is pitched by the game player 100 through the scoring area 80; sixth, the first team of game players 100 to achieve a score of twenty-one (21) without going over wins the game; seventh, an numerical value exceeding twenty-one (21) is subtracted from the respective team of players 100 score and continues in this fashion until one (1) team of players 100 achieves the score of 21; last, upon conclusion of the game 5, the game assemblies 10*a*, 10*b* may be locked together utilizing the hasp locks hasps 300*a*, 320*a* and 300*b*, 320*b* having the scoring devices 20 stored therein.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. A game, comprising:

a first game assembly comprising:

a first game first side;

a first game second side;

a first game third side opposite said first game first side;

a first game fourth side opposite said first game second side;

a first game first divider, horizontally disposed between said first game fourth side and said first game second side;

a first game second divider, vertically disposed between said first game first divider and said first game first side;

a first game third divider, adjacent said first game second divider and vertically disposed between said first game first divider and said first game first side;

a first game fourth divider, vertically disposed between said first game first divider and said first game third side;

a first game board secured beneath said first game first side, said first game second side, said first game third side and said first game fourth side; and, a first pair of legs moveably secured to opposite external sides of said first game;

wherein said first game first divider, said first game second divider, said first game third divider and said first game fourth divider are positioned to create a first plurality of scoring regions;

a second game assembly comprising:

a second game first side;

a second game second side;

a second game third side opposite said second game first side;

a second game fourth side opposite said second game second side;

a second game first divider, horizontally disposed between said second game fourth side and said second game second side;

a second game second divider, vertically disposed between said second game first divider and said second game first side;

a second game third divider, adjacent said second game second divider and vertically disposed between said second game first divider and said second game first side;

a second game fourth divider, vertically disposed between said second game first divider and said second game third side;

a second game board secured beneath said second game first side, said second game second side, said second game third side and said second game fourth side; and, a second pair of legs moveably secured to opposite external sides of said second game;

wherein said second game first divider, said second game second divider, said second game third divider and said second game fourth divider are positioned to create a second plurality of scoring regions;

at least one scoring device;

a locking mechanism;

a first game handle secured upon said first game first side; and, a second game handle secured upon said second game first side;

wherein said first game and said second game are capable of being removably secured together by said locking mechanism in a position having said first game and said second game facing each other with said first game board and said second game board on an outside of said game;

wherein a plurality of said first plurality of scoring regions and a plurality of said second plurality of scoring regions are each individually capable of retaining said at least one said scoring device therein wherein said first game board does not cover one of said first plurality of scoring regions, thereby rendering one of said first plurality of scoring regions open at both ends;

wherein said second game board does not cover one of said second plurality of scoring regions, thereby rendering one of said second plurality of scoring regions open at both ends; and, wherein said one of said first plurality of scoring regions open at both ends and said one of said second plurality of scoring regions open at both ends are each located in an identical position relative to each respective game board.

2. The game of claim 1, wherein said first plurality of scoring regions number five.

3. The game of claim 2, wherein said second plurality of scoring regions number five.

4. The game of claim 1, wherein said locking mechanism comprises a first hasp disposed between said first game first side and said second game first side.

5. The game of claim 4, wherein said locking mechanism comprises a second hasp disposed between said first game third side and said second game third side.

6. The game of claim 5, where said first plurality of scoring regions and said second plurality of scoring regions comprise indicia having a numerical value.

7. A game, comprising:

a first game comprising:

a first game first side;

a first game second side;

a first game third side opposite said first game first side;

a first game fourth side opposite said first game second side;

a first game first divider, horizontally disposed between said first game fourth side and said first game second side;

a first game second divider, vertically disposed between said first game first divider and said first game first side;

a first game third divider, adjacent said first game second divider and vertically disposed between said first game first divider and said first game first side;

a first game fourth divider, vertically disposed between said first game first divider and said first game third side;

a first game board secured beneath said first game first side, said first game second side, said first game third side and said first game fourth side;

a first pair of legs moveably secured to opposite external sides of said first game; and, a first pair of leg stops secured at opposite ends of said first game adjacent said first pair of legs;

wherein said first game first divider, said first game second divider, said first game third divider and said first game fourth divider are positioned to create a first plurality of scoring regions;

a second game comprising:

a second game first side;

a second game second side;

a second game third side opposite said second game first side;

a second game fourth side opposite said second game second side;

a second game first divider, horizontally disposed between said second game fourth side and said second game second side;

a second game second divider, vertically disposed between said second game first divider and said second game first side;

a second game third divider, adjacent said second game second divider and vertically disposed between said second game first divider and said second game first side;

a second game fourth divider, vertically disposed between said second game first divider and said second game third side;

a second game board secured beneath said second game first side, said second game second side, said second game third side and said second game fourth side;

a second pair of legs moveably secured to opposite external sides of said second game; and, a second pair of leg stops secured at opposite ends of said second game first side adjacent said second pair of legs;

wherein said second game first divider, said second game second divider, said second game third divider and said second game fourth divider are positioned to create a second plurality of scoring regions;

at least one scoring device;

a locking mechanism;

a first game handle secured upon said first game first side; and, a second game handle secured upon said second game first side;

wherein said first game and said second game are capable of being removably secured together by said locking mechanism in a position having said first game and said second game facing each other with said first game board and said second game board on an outside of said game;

wherein a plurality of said first plurality of scoring regions and a plurality of said second plurality of scoring regions are each individually capable of retaining said at least one said scoring device therein wherein said first game board does not cover one of said first plurality of scoring regions, thereby rendering one of said first plurality of scoring regions open at both ends;

wherein said second game board does not cover one of said second plurality of scoring regions, thereby rendering one of said second plurality of scoring regions open at both ends; and, wherein said one of said first plurality of scoring regions open at both ends and said one of said second plurality of scoring regions open at both ends are each located in an identical position relative to each respective game board.

8. The game of claim 7, wherein said first plurality of scoring regions number five.

9. The game of claim 8, wherein said second plurality of scoring regions number five.

10. The game of claim 7, wherein said locking mechanism comprises a first hasp disposed between said first game first side and said second game first side.

11. The game of claim 10, wherein said locking mechanism comprises a second hasp disposed between said first game third side and said second game third side.

12. The game of claim 11, where said first plurality of scoring regions and said second plurality of scoring regions comprise indicia having a numerical value.

* * * * *